US008217560B2

(12) United States Patent
Giffels et al.

(10) Patent No.: US 8,217,560 B2
(45) Date of Patent: Jul. 10, 2012

(54) CORONA IGNITION DEVICE AND METHOD FOR ITS MANUFACTURE

(75) Inventors: Thomas Giffels, Stuttgart (DE); Timo Stifel, Muenchingen (DE); Steffen Bohne, Freiberg (DE); Ganghuan Ruan, Ludwigsburg (DE); Helmut Mueller, Hessigheim (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 0 days.

(21) Appl. No.: 13/221,258

(22) Filed: Aug. 30, 2011

(65) Prior Publication Data

US 2012/0056522 A1 Mar. 8, 2012

(51) Int. Cl.
*H01T 13/20* (2006.01)

(52) U.S. Cl. ..... 313/136; 313/137; 313/141

(58) Field of Classification Search ..... 313/136, 313/137, 140, 141, 143
See application file for complete search history.

(56) References Cited

U.S. PATENT DOCUMENTS

| | | | |
|---|---|---|---|
| 2004/0129241 | A1 | 7/2004 | Freen |
| 2008/0141967 | A1 | 6/2008 | Tani et al. |
| 2009/0031988 | A1 | 2/2009 | Shiraishi et al. |
| 2009/0146542 | A1 | 6/2009 | Jaffrezic et al. |

FOREIGN PATENT DOCUMENTS

| | | | |
|---|---|---|---|
| DE | 197 47 700 | A1 | 5/1999 |
| DE | 100 37 536 | A1 | 2/2002 |

*Primary Examiner* — Vip Patel

(57) ABSTRACT

The invention relates to an ignition device for igniting fuel in an internal combustion engine by means of a corona discharge, comprising an ignition electrode, an outer conductor which surrounds the ignition electrode and has a forward end and a rear end, and an electrical insulator which is arranged between the ignition electrode and the outer conductor, wherein the insulator and the ignition electrode project beyond the forward end of the outer conductor in longitudinal direction and the ignition electrode comprises a plurality of electrode branches which each start from a base point, wherein the insulator extends beyond the base points in longitudinal direction. According to the invention an end surface of the electrode branches is uncovered.

12 Claims, 3 Drawing Sheets

1
2
3
4a
4b
6

1
2
3
4a
4b
6
7
8
9
10

CORONA IGNITION DEVICE AND METHOD FOR ITS MANUFACTURE

The invention relates to a corona ignition device the ignition electrode of which comprises a plurality of electrode branches. Such a corona ignition device is known from DE 197 47 700 A 1.

WO 2004/063560 A1 discloses how a fuel-air mixture in a combustion chamber of an internal combustion engine can be ignited by a corona discharge generated in the combustion chamber. To this end, an ignition electrode is passed through one of the walls of the combustion chamber in an electrically insulating manner, the walls being applied to ground potential, and projects into the combustion chamber, preferably opposite a piston provided in the combustion chamber. Along with the walls of the combustion chamber, which are applied to ground potential, the ignition electrode forms a capacitance as a counter electrode. The insulator surrounding the ignition electrode and the combustion chamber with its content act like a dielectric medium. Depending on the cycle of the piston, air or a fuel-air mixture or an exhaust gas is present in said combustion chamber.

The capacitance is a component of an electric resonant circuit which is energized by means of a high-frequency voltage which, for example, is generated by means of a transformer with a center tap. The transformer cooperates with a switching device which alternately applies a specifiable direct current voltage to the two primary windings of the transformer, which are separated by the center tap. The secondary winding of the transformer feeds a series resonant circuit which comprises the capacitance which is formed by the ignition electrode and the walls of the combustion chamber. The frequency of the alternating current voltage that energizes the resonant circuit is controlled such that it is as close to the resonant frequency of the resonant circuit as possible. This results in a voltage overshoot between the ignition electrode and the walls of the combustion chamber in which the ignition electrode is arranged. Typically, the resonant frequency is between 30 kilohertz and 3 megahertz, and the alternating voltage reaches values of, e.g., 50 kV to 500 kV at the ignition electrode. This allows generating a corona discharge in the combustion chamber.

The ignition tips of corona ignition devices are sensitive. This is especially true for ignition devices with a plurality of ignition tips. In order to prevent damage during transport, use is usually made of cardboard tubes which can be slipped onto the head of an ignition device and will then surround the ignition tip or ignition tips.

The object of the invention is to show a way how the protection of the ignition tips of corona ignition devices against damage can be improved.

SUMMARY OF THE INVENTION

Protection of the ignition tips can be achieved according to the invention in that the insulator extends beyond the base points of the electrode branches in longitudinal direction, preferably, all the way to the free ends of the electrode branches, i.e., the ignition tips. In this manner, the insulator is used to protect the ignition tips against damage to a great extent. Therein, it is to particular advantage that the insulator also protects the ignition tips when the ignition device is installed into an engine. The electrode branches can be covered by insulator material. However, one aspect of the invention provides that at least one end surface of the electrode branches is uncovered. The distal end of the electrode branches will then be free, with the result that a corona discharge can originate from there in an unimpeded manner.

In an ignition device according to the invention, the insulator can, for example, comprise a raised edge at its forward end, said edge extending beyond the base points and, preferably, also beyond the ignition tips in longitudinal direction. In this case, the insulator has a deepening at its forward end, with the electrode branches being arranged above a front surface of the insulator in said deepening. Preferably, the deepening has a surface that is rising up to the edge in a radially outward direction because, in this manner, a mechanically stable insulator can be implemented. It is, however, also possible that the insulator has a flat front surface in the deepening, said flat front being surrounded by an edge of the insulator, said edge being raised in a wall-like or bulge-like manner.

According to a further possibility, the insulator comprises a front surface with recesses extending in radial direction, for example chute-like recesses, in which the electrode branches are positioned. Such elongated recesses can be formed closed or open towards the outside, i.e., towards a circumferential surface of the insulator. The recesses may have a constant width. However, it is better when the recesses broaden outwardly, for example, in the form of a funnel. The electrode branches can project from the recesses with their free, i.e., distal end. Preferably, however, the distal ends of the electrode branches are positioned in the chute-like recesses.

Preferably, the electrode branches are embedded in the insulator body. For example, the front surface of the insulator body can have chute-like recesses in which the electrode branches are positioned.

Preferably, the ignition electrode is protected against damage by being spray coated with insulator material. In this manner, the electrode branches can be efficiently protected against bending and, therefore, against damage due to the electrode branches being embedded in insulator material. Therein, it is possible that the electrode branches project a little from the insulation material with their free, i.e., distal ends. In particular, the electrode branches can project from the insulator laterally, i.e., in radial direction. It is also possible that the electrode branches project from the insulator in longitudinal direction, for example, from a forward end surface of the insulator. The insulator does not have to extend beyond the ends of the ignition tips in longitudinal direction because a short end section of the electrode branches of, for example, less than 2 mm can, anyway, be bent only difficulty because of its short length. Preferably, however, the electrode branches are embedded in insulator material over their entire length and their complete circumference.

If the electrode branches are embedded in insulator material over their entire length and their complete circumference, their end can be covered by a thin insulator layer which is, for example, up to 10 μm thick without this preventing a corona discharge. Preferably, however, an end surface of the electrode branches is uncovered; this can be achieved by grinding off the insulator covering the electrode branches.

If the ignition electrode is spray coated with insulator material, the insulator of the ignition device can be fully formed while the ignition electrode is being spray coated. Preferably, however, the insulator consists of a ceramic insulator block into which a rear section of the ignition electrode is inserted and sprayed-on insulator material in which the electrode branches are embedded. The material used for spray coating can be ceramic material, particularly the same material like that for the insulator block, for example, aluminum oxide. Preferably, however, use is made of a different material which can be processed more easily by spray coating, for example, flame spray coating or a slip casting method. It is also possible to use a polymer material, for example, wax or plastic for spray coating. The polymer material can be used to protect the ignition electrode embedded therein while the ignition device is being installed into the engine. After completed installation, the polymer material combusts in the combustion chamber of the engine.

If the electrode branches are embedded in ceramic insulator material, a compensation layer can be arranged between the insulator material and the electrode branches in order to reduce mechanical tensions which may be generated by different thermal expansion coefficients of the material of the electrode branches and the insulator. The compensation layer can consist of metal and/or ceramic, more particularly of a plurality of different material layers.

In a method according to the invention, the ignition electrode is spray coated with insulator material and, therefore, protected against damage. Therein, the ignition electrode can, in the simplest case, be designed as a metal pin which extends in the insulator and integrally forms both an ignition tip and an inner conductor. Preferably, however, the spray coated ignition electrode comprises a plurality of electrode branches. For example, a pin which extends in the insulator in longitudinal direction and is, usually, referred to as center electrode can carry a separately formed head with a plurality of electrode branches, for example, be welded to the pin.

BRIEF DESCRIPTION OF THE DRAWINGS

Further details and advantages of the invention are illustrated by means of exemplary embodiments with reference being made to the accompanying drawings. Therein, identical parts which correspond to each other are designated with corresponding reference symbols. In the drawings.

DETAILED DESCRIPTION

Figures 1, 2, 3:
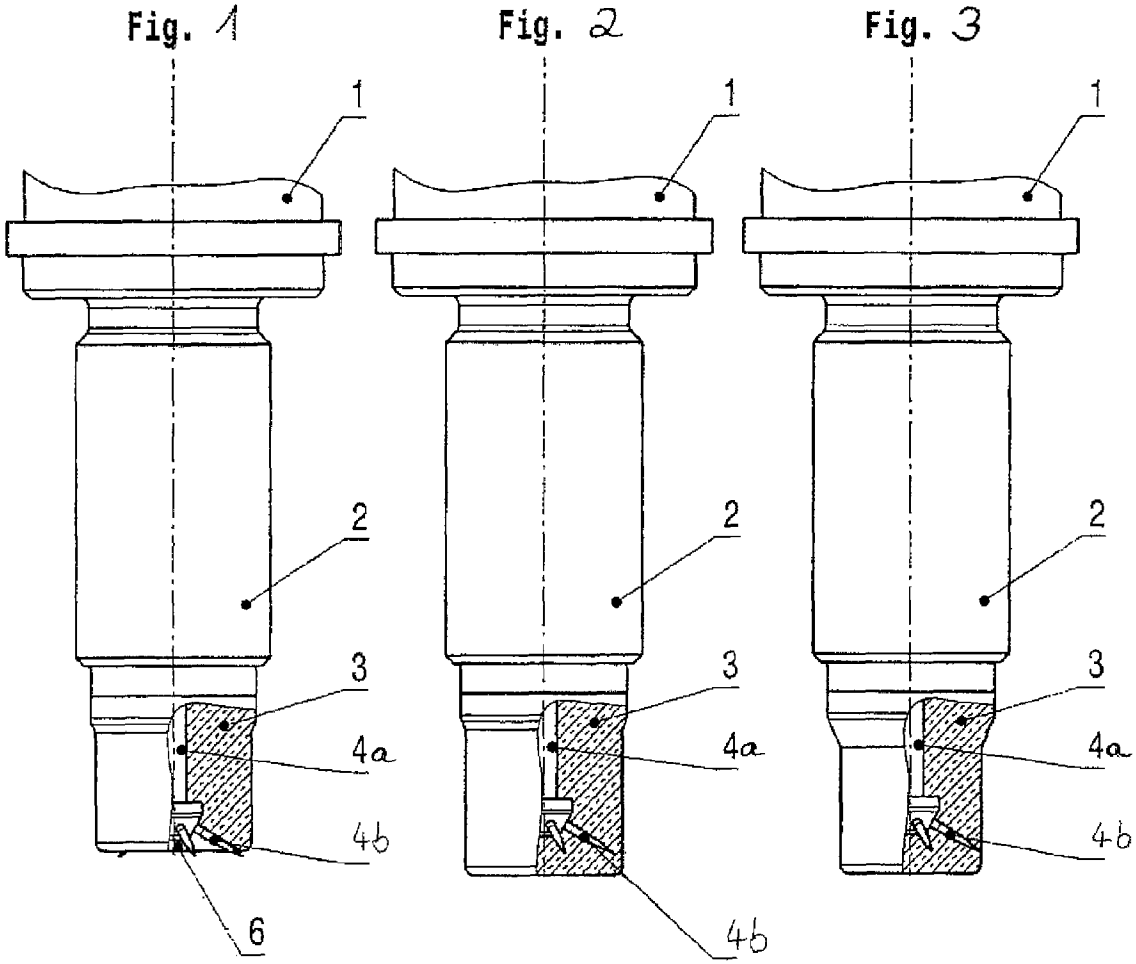
FIG. 1 is a partial sectional view of an exemplary embodiment of an ignition electrode.
FIG. 2 is a partial sectional view of a further exemplary embodiment of an ignition electrode before abrasion of insulator material.
FIG. 3 is a partial sectional view of a further exemplary embodiment of an ignition electrode.

The ignition device 1 shown in FIG. 1 has a tubular outer conductor 2, an insulator 3 surrounded by the outer conductor 2, and in ignition electrode 4*a*, 4*b*. The ignition electrode consists of a pin 4*a* extending in longitudinal direction, said pin 4*a* being concentrically surrounded by the insulator 3 and the outer conductor 2, and a plurality of electrode branches 4*b* which each start from a base point and end in an ignition tip. In the exemplary embodiment shown, the ignition tips start from a head part which is seated on, for example, slipped onto the pin 4*a* of the ignition electrode 4*b*.

The insulator 3 and the ignition electrode 4*a*, 4*b* project from a forward combustion-chamber-sided end of the outer conductor 2. The insulator 3 extends beyond the base points of the electrode branches 4*b* in longitudinal direction, thus protecting the electrode branches 4*b* against damage. In the exemplary embodiment shown in FIG. 1, the insulator 3 has a deepening 6 at its forward end, with the electrode branches 4*b* being arranged in said deepening 6 above a forward front surface of the insulator. For example, the deepening can be formed in the form of a cylinder or funnel, as it is shown in FIG. 1. Preferably, the electrode branches 4*b* are embedded in the insulator. For example, the forward end surface of the insulator 3 can comprise chute-like deepenings, e.g. furrows or grooves, in which the electrode branches 4*b* are positioned.

Along with the ignition electrode, more particularly the pin 4*a*, the outer conductor 2 forms a capacitor. Along with a coil (not shown) arranged in the rear part of the ignition device 1, the capacitor is a part of a resonant circuit for high-frequency excitation of the ignition electrode.

FIG. 2 shows a further exemplary embodiment which, essentially, differs from the exemplary embodiment described above only in that the electrode branches 4*b* are completely embedded in the insulator 3. The electrode branches 4*b* are surrounded by insulator material 3 over their entire length and their complete circumference. Therein, the free ends of the electrode branches 4*b* are covered by a thin layer of insulator material 3. If voltages are high, a thin layer which is, for example, up to 10 μm thick is electrically penetrable to a degree that is sufficient for not preventing a corona discharge. Nonetheless, the thickness of this layer should be reduced to zero by abrasion in a finishing step.

Preferably, the ignition electrode is spray coated with insulator material for manufacturing the ignition device shown. For example, the pin 4*a* of the ignition electrode can be inserted into a ceramic insulator block and, subsequently, the section of the ignition electrode with the electrode branches that projects from the insulator block can be embedded in insulator material 3 by being spray coated. After completed spray coating, a sintering step can be made, particularly when the ignition electrode is spray coated with ceramic insulator material, for example, with a slip casting method.

The thickness of the insulator layer covering the free ends of the electrode branches 4*b* can be adjusted to a desired value by abrasion, for example by grinding. It is to particular advantage if the thickness is reduced to zero, as this is the case in the exemplary embodiment shown in FIG. 3. In the exemplary embodiment shown in FIG. 3, the insulator material 3 covering the electrode branches 4*b* were ground off until end surfaces of the electrode branches 4*b* were exposed.

Figures 4, 5, 6, 7:
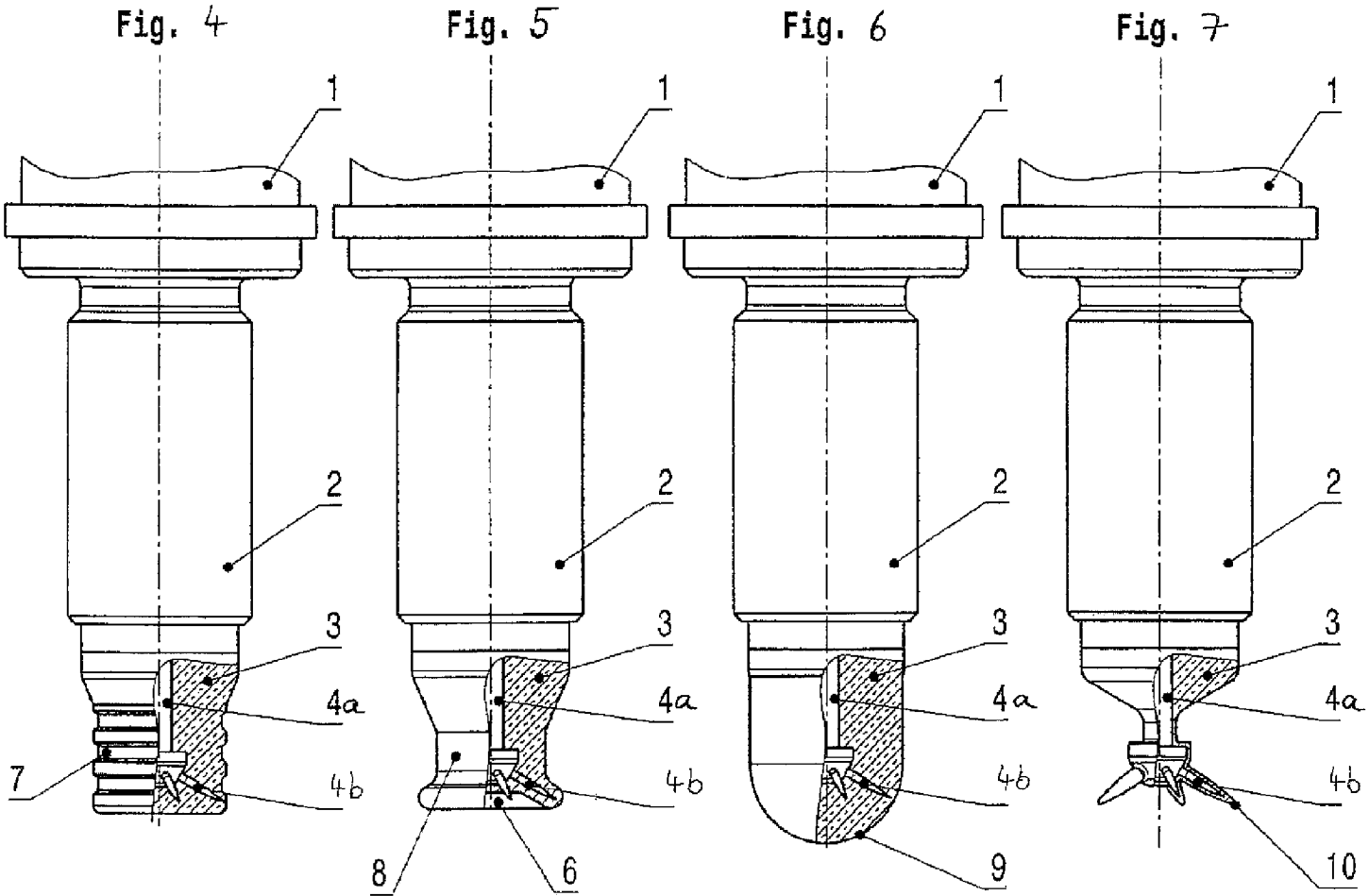
FIG. 4 is a partial sectional view of a further exemplary embodiment of an ignition electrode.
FIG. 5 is a partial sectional view of a further exemplary embodiment of an ignition electrode before abrasion of insulator material.
FIG. 6 is a partial sectional view of a further exemplary embodiment of an ignition electrode before abrasion of insulator material.
FIG. 7 is a partial sectional view of a further exemplary embodiment of an ignition electrode before abrasion of insulator material.

FIG. 4 shows a further exemplary embodiment of an ignition device 1. The essential difference from the exemplary embodiments illustrated above is that a section of the insulator 3, which is projecting from the outer conductor 2, comprises circumferential grooves 7. The grooves 7 increase the sliding distance and, therefore, contribute to reducing sliding discharges. In the exemplary embodiments shown in FIGS. 1 and 2, such grooves 7 can, advantageously, also be provided in a lateral surface of the insulator 3. In addition, the grooves 7 form an undercut of the insulator 3 and, therefore, reduce the volume projecting into the combustion chamber.

FIG. 5 shows a further exemplary embodiment of an ignition device 1. In this exemplary embodiment, the section of the insulator 3, which projects from the outer conductor 2, has an undercut 8. In this manner, the insulator volume projecting into the combustion chamber is reduced. Insulator material covering the ends of the electrode branches can be removed by abrasion.

FIG. 6 shows a further exemplary embodiment of an ignition device 1. In this exemplary embodiment, the insulator 3 has a roundness 9 at its forward end, said roundness 9, preferably, being hemispherical. Such a shape of the insulator 3 is, in particular, advantageous if the electrode branches 4*b* are not only arranged as a single wreath but if one or a plurality of electrode branches that are directed more towards the front are also provided. In such a case, the shape of the insulator 3 shown in FIG. 6 is to advantage in that the orientation of the corona on the individual ignition tips is, in essence, always perpendicular to the insulator surface. Insulator material covering the ends of the electrode branches can be removed by abrasion in a finishing step.

If the electrode branches 4*b* are arranged in the form of a wreath, as this is, for example, shown in FIG. 2, this can, for example, also be achieved with a chamfer or rounding on the insulator 3, said chamfer or rounding being designed at such an angle that the surface is perpendicular to the axis of the electrode branch 4*b*. By deviating from this exit angle from the surface, however, it is also possible to deliberately direct the corona discharge into one direction, with the result that a different angle can also be optimal, depending on the particular case.

FIG. 7 shows a further exemplary embodiment of an ignition device 1, in which the insulator 3 forms a thin protective layer which envelops the electrode branches 4*b*. Insulator material covering the ends of the electrode branches can be removed in a finishing step.

The thermal load of the electrode branches 4*b* in the combustion chamber can, advantageously, be reduced by embedding said electrode branches 4*b* in ceramic insulator material. By fully enveloping the electrode branches 4*b*, the ignition electrode can, additionally, also be protected against chemical attacks in the combustion chamber. Thereby, the wear of the ignition tips can, advantageously, be reduced. In particular, it is also possible to manufacture the electrode branches from a material that is chemically less resistant and, therefore, more cost-effective and more easily processible.

Figure 8:
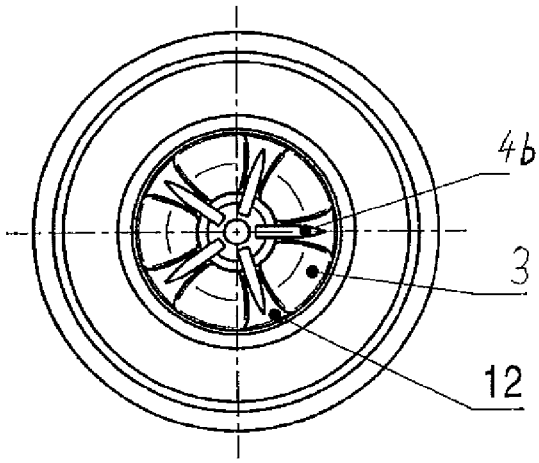
FIG. 8 is a partial sectional view of a further exemplary embodiment of an ignition electrode.
Figure 9:
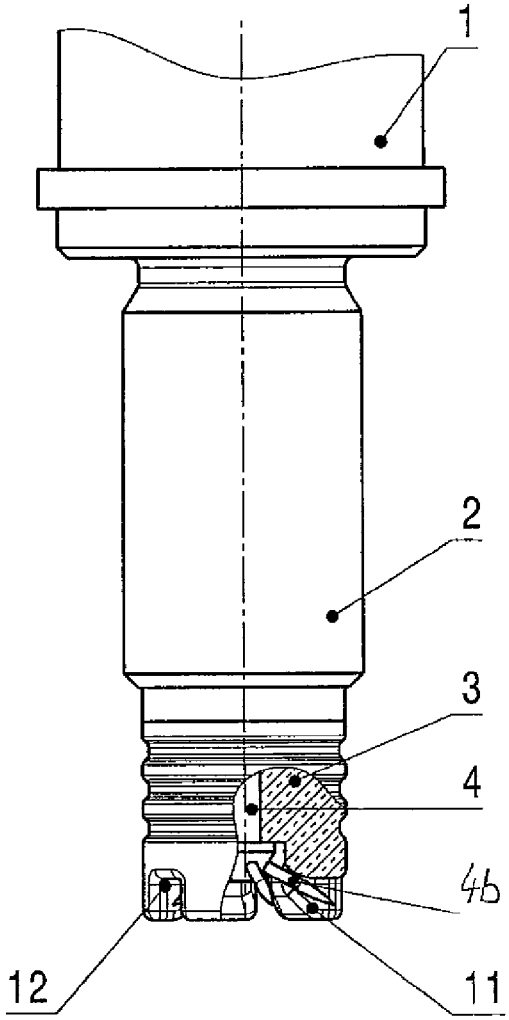
FIG. 9 is a front view of FIG. 8.

FIGS. 8 and 9 show a further exemplary embodiment which is a modification of the exemplary embodiment of FIG. 1. At its front surface, the insulator 3 comprises grooves or chutes 12 in which the electrode branches 4*b* are positioned. The chutes 12 broaden outwardly and are open to the outside. In other words, the chutes 12 broaden in a radially outward direction, i.e., towards the circumference of the insulator and are open towards the circumferential surface of the insulator 3. Therein, the electrode branches 4*b* end in the chutes 12 and are uncovered. Each distal end of the electrode is, therefore, positioned in one of the chutes 12 which the insulator comprises at its combustion-chamber-sided end. Between the chutes 12, the insulator 3 has elevations 11 on its front side.

In these chutes 12, the electrode branches 4*b* are well protected against damage and a corona discharge starting from the electrode branches 4*b* can, effectively, disperse into the combustion chamber.

Reference Symbols

1 Ignition device
2 Outer conductor
3 Insulator
4*a* Pin
4*b* Electrode branches
6 Deepening
7 Grooves
8 Undercut
9 Roundness
10 Protective layer
11 Elevations
12 Chute

What is claimed is:

1. An ignition device for igniting fuel in an internal combustion engine by means of a corona discharge, the ignition device comprising:

an ignition electrode, an outer conductor surrounding the ignition electrode and having a forward end and a rear end, and an electrical insulator disposed between the ignition electrode and the outer conductor, wherein the insulator and the ignition electrode project beyond the outer conductor forward end in a longitudinal direction, the ignition electrode comprises a plurality of electrode branches each starting from a base point, the insulator extends beyond the base points in longitudinal direction, and an end surface of the electrode branches is uncovered.

2. The ignition device according to claim 1, wherein the electrode branches are embedded in the insulator.

3. The ignition device according to claim 1, wherein the insulator comprises a deepening at its forward end, with the base points of the electrode branches being arranged in said deepening.

4. The ignition device according to claim 1, wherein the electrode branches are embedded in the insulator over an entire length thereof.

5. The ignition device according to claim 1, wherein the insulator comprises a ceramic insulator block, surrounding a rear section of the ignition electrode, and additional insulator material, sprayed onto the insulator block and surrounding the electrode branches.

6. The ignition device according to claim 5, wherein the additional insulator material is a polymer.

7. The ignition device according to claim 1, wherein a section of the insulator that projects from the outer conductor comprises circumferential grooves.

8. The ignition device according to claim 1, wherein a section of the insulator that projects from the outer conductor has an undercut.

9. The ignition device according to claim 1, wherein the insulator comprises recesses in which the electrode branches are positioned.

10. The ignition device according claim 9, wherein the recesses broaden outwardly.

11. The ignition device according to claim 9, wherein the recesses are open towards a circumferential surface of the insulator.

12. The ignition device according to claim 9, wherein the electrode branches end in the recesses.

* * * * *